US010444675B2

(12) United States Patent
Mizuno

(10) Patent No.: US 10,444,675 B2
(45) Date of Patent: Oct. 15, 2019

(54) IMAGE FORMING APPARATUS

(71) Applicant: Brother Kogyo Kabushiki Kaisha, Nagoya-shi, Aichi-ken (JP)

(72) Inventor: Yusuke Mizuno, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/144,047

(22) Filed: Sep. 27, 2018

(65) Prior Publication Data

US 2019/0146385 A1 May 16, 2019

(30) Foreign Application Priority Data

Nov. 14, 2017 (JP) ..... 2017-218740

(51) Int. Cl.
*G03G 15/00* (2006.01)
*G03G 15/20* (2006.01)

(52) U.S. Cl.
CPC ..... *G03G 15/2028* (2013.01); *G03G 15/2064* (2013.01); *G03G 15/602* (2013.01); *G03G 15/6511* (2013.01)

(58) Field of Classification Search
CPC ..... G03G 15/602
See application file for complete search history.

(56) References Cited

U.S. PATENT DOCUMENTS 7,031,630 B2 4/2006 Endo
8,121,508 B2 2/2012 Hasegawa et al.
2004/0136744 A1 7/2004 Endo
2009/0317102 A1 12/2009 Hasegawa et al.
2013/0292896 A1* 11/2013 Yoshii ..... B65H 1/14 271/97

FOREIGN PATENT DOCUMENTS

| | | | |
|---|---|---|---|
| JP | H06-301225 | A | 10/1994 |
| JP | 2003-122178 | A | 4/2003 |
| JP | 2004-163758 | A | 6/2004 |
| JP | 2006-133310 | A | 5/2006 |
| JP | 2010-002702 | A | 1/2010 |
| JP | 2017-032774 | A | 2/2017 |

* cited by examiner

*Primary Examiner* — Clayton E. LaBalle
*Assistant Examiner* — Jas A Sanghera
(74) *Attorney, Agent, or Firm* — Banner & Witcoff, Ltd.

(57) ABSTRACT

An image forming apparatus includes a main body, a sheet tray, a pressure plate configured to lift up a sheet to a feedable position, a fixing device, a driving source configured to supply a driving force for a driving operation of driving the pressure plate and the fixing device, an interface, and a controller. A temperature of the fixing device is detected by a temperature sensor of the fixing device. The controller is configured to start heating the fixing device in response to receipt of a printing instruction, and start the driving operation on condition that the temperature reaches a particular temperature. The controller sets the particular temperature to a first temperature X1 when the pressure plate has placed the sheet to the feedable position, and a second temperature X2 lower than the first temperature X1 when the pressure plate has not placed the sheet to the feedable position.

11 Claims, 6 Drawing Sheets

IMAGE FORMING APPARATUS

CROSS-REFERENCE TO RELATED APPLICATIONS

This application claims priority under 35 U.S.C. § 119 from Japanese Patent Application No. 2017-218740 filed on Nov. 14, 2017. The entire subject matter of the application is incorporated herein by reference.

BACKGROUND

Technical Field

The present disclosures relate to an image forming apparatus provided with a fixing device.

Related Art

There is known an image forming apparatus configured to form an image on a sheet in accordance with an electrophotographic image forming method. In such an image forming apparatus, it is desired that a time for raising a temperature of a fixing device to a particular temperature in response to receipt of a printing instruction is shortened in order to reduce a time necessary for forming an image on the sheet after receiving the printing instruction. According to an exemplary conventional image forming apparatus, the fixing device is provided with a heat roller and a press roller, and rotation of the press roller is interrupted when the temperature of the heat roller is being raised to suppress absorption of temperature by the press roller.

SUMMARY

When the image forming apparatus is configured such that an operation of lifting a pressure plate of a sheet tray and an operation of conveying the sheet with the fixing device are performed with use of a single driving source, the pressure plate does not move during a period in which the heat roller is not being rotated. Therefore, if the printing instruction is received when the pressure plate is not placed at a position for feeding the sheet, it is necessary that the pressure plate should be lifted after the temperature of the fixing device has been raised to the particular temperature. Due to this waiting time, start of the printing operation of a first sheet is delayed.

According to aspects of the present disclosure, there is provided an image forming apparatus. The image forming apparatus includes a main body, a sheet tray configured to mount a sheet thereon, the sheet tray being attachable to and detachable from the main body, a pressure plate provided to the sheet tray, the pressure plate being configured to lift up the sheet to a feedable position, a fixing device including a heater and a temperature sensor, the fixing device being configured to convey the sheet and thermally fix a developer image on the sheet, the temperature sensor being configured to detect a temperature of the fixing device, a driving source configured to supply a driving force for a driving operation of driving the pressure plate to lift up the sheet and driving the fixing device to convey the sheet, an interface configured to receive a printing instruction, and a controller. The controller is configured to start heating the fixing device by the heater in response to receipt of the printing instruction through the interface, and control the driving source to start the driving operation on condition that the temperature detected by the temperature sensor reaches a particular temperature. The controller sets, in response to receipt of the printing instruction, the particular temperature to a first temperature X1 when the pressure plate has placed the sheet to the feedable position, and a second temperature X2 lower than the first temperature X1 when the pressure plate has not placed the sheet to the feedable position.

According to aspects of the present disclosure, there is provided an image forming apparatus. The image forming apparatus includes a main body, a sheet tray configured to mount a sheet thereon, the sheet tray being attachable to and detachable from the main body, a pressure plate attached to the sheet tray, the pressure plate being configured to lift up the sheet to a feedable position, a fixing device including a heater, the fixing device being configured to convey the sheet and thermally fix a developer image on the sheet, a driving source configured to supply a driving force for a driving operation of driving the pressure plate to lift up the sheet and driving the fixing device to convey the sheet, an interface configured to receive a printing instruction, and a controller. The controller is configured to start heating the fixing device by the heater in response to receipt of the printing instruction through the interface, and control the driving source to start the driving operation on condition that a particular time period has elapsed from a reference time set at a time after receiving the printing instruction. The controller sets, in response to receipt of the printing instruction, the particular period to a first time period T1 when the pressure plate has placed the sheet to the feedable position, and a second time period T2 shorter than the first time period T1 when the pressure plate has not placed the sheet to the feedable position.

According to aspects of the present disclosure, there is provided an electrophotographic image forming apparatus. The electrophotographic image forming apparatus includes a housing, a process unit configured to form a developer image on a sheet, a sheet tray attachable to and detachable from the housing, the sheet tray comprising a pressure plate configured to support the sheet mount thereon, the pressure plate being movable between a first position where the pressure plate lifts up the sheet and a second position where the pressure plate does not lift up sheet, a pickup roller configured to contact the sheet when the pressure plate is in the first position and feed the sheet to the process unit, a fixing device including a heater and a temperature sensor, the fixing device being configured to convey the sheet and thermally fix a developer image on the sheet, the temperature sensor being configured to detect a temperature of the fixing device, a motor configured to drive the pressure plate, the process unit, the pickup roller and the fixing device, and a controller. The configured is configured to set a particular temperature to a first temperature X1 if the pressure plate is placed at the first position when receiving a printing instruction, set the particular temperature to a second temperature X2 lower than the first temperature X1 if the pressure plate is placed at the second position when receiving the printing instruction, and start heating the fixing device by controlling the heater in response to receipt of the printing instruction and start driving the motor on condition that the temperature detected by the temperature sensor reaches the particular temperature.

According to aspects of the present disclosure, there is provided an electrophotographic image forming apparatus. The electrophotographic image forming apparatus includes a housing, a process unit configured to form a developer image on a sheet, a sheet tray attachable to and detachable from the housing, the sheet tray comprising a pressure plate configured to support the sheet mount thereon, the pressure plate being movable between a first position where the pressure plate lifts up the sheet and a second position where the pressure plate does not lift up sheet, a pickup roller configured to contact the sheet when the pressure plate is in the first position and feed the sheet to the process unit, a fixing device including a heater, the fixing device being configured to convey the sheet and thermally fix a developer image on the sheet, a motor configured to drive the pressure plate, the process unit, the pickup roller and the fixing device, and a controller. The controller is configured to start heating the fixing device by the heater in response to receipt of a printing, set a particular time period to a first time period T1 if the pressure plate is placed at the first position when receiving the printing instruction, set the particular time period to a second time period T2 shorter than the first time period T1 if the pressure plate is placed at the second position when receiving the printing instruction, and start driving the motor on condition that the particular time period has elapsed from a reference time set at a time after receiving the printing instruction.

BRIEF DESCRIPTION OF THE ACCOMPANYING DRAWINGS

FIG. 1 schematically shows a cross-sectional side view illustrating a general configuration of an image forming apparatus according to an illustrative embodiment of the present disclosures.

FIGS. 5B-1 through 5B-5 show a timing chart corresponding to FIG. 5A and according to the illustrative embodiment.

FIGS. 5C-1 through 5C-5 show a timing chart corresponding to FIG. 5A and according to a conventional art.

DETAILED DESCRIPTION OF THE EMBODIMENTS

Hereinafter, referring to the accompanying drawings, illustrative embodiments according to the present disclosures will be described. In the following description, directions indicated in FIG. 1 will be referred to. That is, a right-hand side, a left-hand side, a farther side, and a closer side with respect to the plane of FIG. 1 will be referred to as a "front" side, a "rear" side, a "right" side and a "left" side of a laser printer 1, respectively. Further, up and down directions of FIG. 1 will be referred to as "up" and "down" direction of the laser printer 1.

Figure 1:
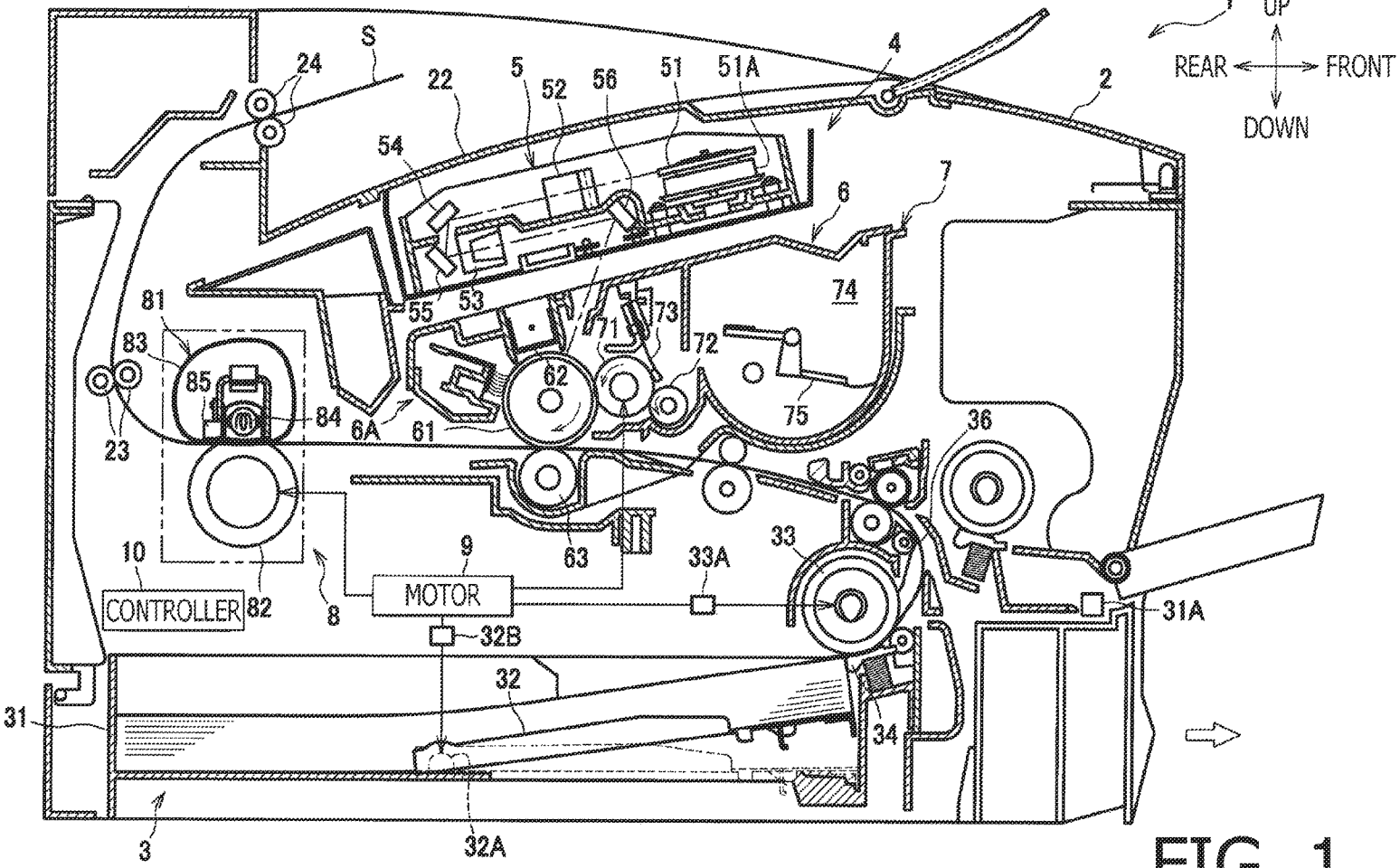

As shown in FIG. 1, the laser printer (which is an example of an image forming apparatus) 1 is configured such that a sheet feeder 3, an electrographic process unit 4 (Hereinafter, the electrographic process unit is also referred to as the process unit), a fixing device 8, a motor 9 and a controller 10 are provided inside a main body 2. The main body 2 is a housing of the laser printer 1. The sheet feeder 3 is configured to feed a sheet S such as a printing sheet. The process unit 4 is configure to form a developer image (e.g., a toner image) on the sheet S. The motor 9 is an example of a driving source.

The sheet feeder 3 is arranged at a lower part of the main body 2, and mainly includes a sheet tray 31 on which a plurality of sheet S is mounted, a sheet tray sensor 31A, a pressure plate 32, a pickup roller 33 and a separation pad 34.

The sheet tray 31 is detachably attached to the main body 2. The sheet tray sensor 31A is arranged on an upper side with respect to a front end part of the sheet tray 31, and is configured to detect an opened/closed state of the sheet tray 31. Specifically, the sheet tray sensor 31A is configured to, for example, transmit an ON signal to the controller 10 when the sheet tray 31 is detached from the main body 2. That is, when receiving the ON signal, the controller 10 determines that the sheet tray 31 is in the opened state, while the controller 10 determines that the sheet tray 31 is in the closed state when the ON signal is not being received.

The pickup roller 33 is arranged on an upper side with respect to the front end part of the sheet tray 31. The pickup roller 33 is connected to the motor 9 through an electromagnetic clutch 33A. The electromagnetic clutch 33A is configured to switchably take a connection state and a disconnection state. In the connection state, the electromagnetic clutch 33A can transmit the driving force of the motor 9 to the pickup roller 33. In the disconnection state, the driving force of the motor 9 is not transmitted to the pickup roller 33. In accordance with the operation state of the electromagnetic clutch 33A, the pickup roller 33 contacts the sheets S stacked on the sheet tray 31 from the above so as to pick up the sheets S one by one.

The pressure plate 32 is provided to the sheet tray 31. The pressure plate 32 is configured to lift the sheets S to a feedable position. Specifically, the pressure plate 32 is rotatable about a rear end part 32A thereof between a lowermost reference position (indicated by broken lines) and a position where the sheets S can be fed (indicated by solid lines). By rotating the pressure plate 32 upward from the reference position, the pressure plate 32 is lifted up to the position where the sheets S can be fed. The pressure plate 32 placed at the position where the sheets S can be fed is closer to the pickup roller 33 than at the reference position. When the pressure plate 32 is placed at the position where the sheets S can be fed, the uppermost sheet S contacts the pickup roller 33, and thereby becoming feedable (i.e., the sheets S are placed at the feedable position).

Specifically, the pressure plate 32 is connected to the motor 9 through a mechanical clutch 32B. The mechanical clutch 32B is configured such that, when the pressure plate 32 is placed at the position where the sheets S can be fed, transmission of the driving force is shut off, while the pressure plate 32 is moved downward by a particular amount or more as the sheets S are used, the mechanical clutch 32B becomes able to transmit the driving force. It is noted that the position where the sheets S can be fed of the pressure plate 32 varies depending on the number of sheets S accommodated in the sheet tray 31.

When the controller 10 starts driving the motor 9, if the pressure plate 32 is not placed at a position where the sheets S can be fed, the mechanical clutch 32B transmits a driving force to the pressure plate 32 from the motor 9. Accordingly, the pressure plate 32 is moved toward the position where the sheets S can be fed. Then, in response to a position of the pressure plate 32 reaching the position where the sheets S can be fed, the mechanical clutch 32B shuts of the transmission of the driving force to the pressure plate 32 from the motor 9 and the movement of the pressure plate 32 is stopped.

On the other hand, when the controller 10 starts driving the motor 9, if the pressure plate 32 is placed at the position where the sheets S can be fed, the mechanical clutch 32B does not transmit the driving force to the pressure plate 32 from the motor 9 and the pressure plate 32 is not moved.

According to this configuration, by driving the motor 9 for more than a particular time, it is possible to move the pressure plate 32 to the position where the sheets S can be fed, and maintain the pressure plate 32 at the position.

When the sheet tray 31 is detached from the main body 2, the pressure plate 32 is moved downward to its lowermost position (i.e., the reference position). That is, when the sheet tray 31 is detached from the main body 2, engagement of gears of a not-shown driving force transmission mechanism is released (i.e., disengaged), thereby the pressure plate moves downward by its own weight.

In the sheet feeder 3, the sheets S on the sheet tray 31 are moved closer to the pickup roller 33 by the pressure plate 32, separated one by one and fed toward the process unit 4 by the pickup roller 33 and the separation pad 34.

The process unit 4 includes an exposing device 5 and a process cartridge 6.

The exposing device 5 is arranged in an upper part of the main body 2. The exposing device 5 mainly includes a laser emitter for emitting laser (not shown), a polygon mirror 51 for deflecting the laser, a polygon motor 51A for rotating the polygon mirror 51, lenses 52 and 53, mirrors 54, 55 and 56. The exposing device 5 is configured such that a laser beam (indicated by a dotted line) emitted by the laser emitter is reflected by the polygon mirror 51, passes through the lens 52, reflected by the mirrors 54 and 55, passes through the lens 53, reflected by the mirror 56 and is incident on a circumferential surface of a photoconductive drum 61. It is noted that the laser beam emitted by the laser emitter is modulated based on image data.

The process cartridge 6 is arranged below the exposing device 5. The process cartridge 6 includes a drum unit 6A and a development unit 7.

The drum unit 6A mainly includes the photoconductive drum 61, a charger 62 and a transfer roller 63. The development unit 7 is configured to be detachably attached to the drum unit 6A and mainly includes a developing roller 71, a supplying roller 72, a thickness regulating blade 73, a developing agent container 74 for containing developing agent, and agitator 75 configured to agitate the developing agent inside the developing agent container 74 and supplying the same to the supplying roller 72.

The developing roller 71 is connected to the motor 9 through a not-shown gear train. Further, the supplying roller 72 and the agitator 75 are connected to the developing roller 71 through a plurality of gear trains (not shown). Accordingly, the developing roller 71, the supplying roller 72 and the agitator 75 can be driven by the motor 9.

In the process cartridge 6, the circumferential surface of the photoconductive drum 61 is uniformly charged by the charger 62, and the charged surface of the photoconductive drum 61 is exposed to the laser beam which is modulated based on the image data and emitted by the exposing device 5, thereby an electrostatic latent image being formed on the surface of the photoconductive drum 61 based on the image data. The developing agent contained in the developing agent container 74 is supplied onto the developing roller 71 through the supplying roller 72, and then supplied between the developing roller 71 and the thickness regulating blade 73, thereby being held on the developing roller 71 as a thin layer having a particular thickness.

The developing agent held on the developing roller 61 is supplied from the developing roller 71 to the electrostatic latent image formed on the photoconductive drum 61. Then, the latent image is developed (i.e., a developer image is formed on the photoconductive drum 61). Thereafter, as the sheet S is conveyed through a nip between the photoconductive drum 61 and the transfer roller 63, the developer image on the photoconductive drum 61 is transferred on the sheet S.

The fixing device 8 is arranged on a rear side relative to the process unit 4. The fixing device 8 is configured to convey the sheet S conveyed from the process cartridge 6 with applying heat so that the developer image transferred on the sheet S is thermally fixed on the sheet S. The sheet S on which the developer image is thermally fixed by the fixing device 8 is further conveyed by the conveying rollers 23 and 24 and is discharged onto a sheet discharge tray 22.

The fixing device 8 includes a heating unit 81 and a pressing unit 82. The heating unit 81 includes a fixing belt 83, a heater 84 and a temperature sensor 85. The heater 84 includes, for example, a halogen lamp which is provided on inner side of a fixing belt 83. The temperature sensor 85 is arranged to detect a temperature of the fixing device 8, specifically, a temperature of a vicinity of a portion at which the heating unit 81 contacts the sheet S.

The pressing unit 82 includes a roller. The pressing unit 82 is connected to the motor 9 through a not-shown gear train. According to this configuration, the pressing unit 82 is configured to be driven to rotate by the motor 9. As the pressing unit 82 rotates, the fixing belt 83 is driven by the pressing unit 82 to rotate. As the sheet S on which the developer image is transferred is conveyed at the nip between the pressing unit 82 and the heated fixing belt 83, the developer image is thermally fixed on the sheet S.

The motor 9 is connected to the pressure plate 32, the fixing device 8, the process unit 4 and the pickup roller 33 so as to drive the pressure plate 32, drive the fixing device 8 to convey the sheet S, drive the process unit 4 and drive the pickup roller 33. In the process unit 4, for example, a driving force of the motor 9 is used for driving the developing roller 71, the supplying roller 72 and the agitator 75. The motor 9 is, for example, a generally-known DC brushless motor, and provided with a hall sensor HS. The hall sensor HS is configured to generate a 1 pulse of hall signal at every particular-angle rotation (e.g., 60 degrees) of the motor 9. The controller 10 is connected to the motor 9 such that the hall signal output by the hall sensor HS of the motor 9 can be received.

Figure 2:
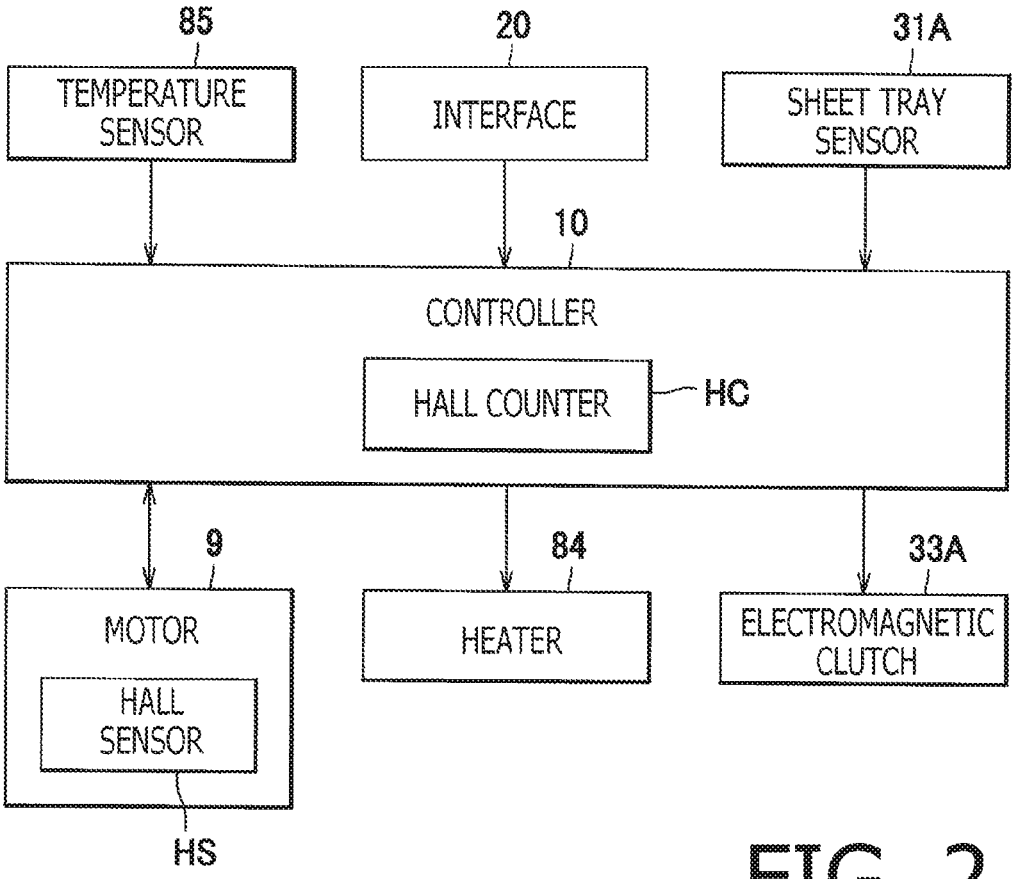
FIG. 2 is a block diagram indicating members connectable to a controller of the image forming apparatus shown in FIG. 1.

As shown in FIG. 2, the controller 10 is of a well-known type of controller provided with a CPU, a ROM, a RAM and the like. The controller 10 is configured to control the motor 9, the heater 84 and the electromagnetic clutch 33A, by executing a preliminarily prepared program, based on information obtained by the sheet tray sensor 31A, the temperature sensor 85 and the hall sensor HS of the motor 9. Further, the controller 10 is provided with a hall counter HC. The hall counter HC is configured to increment a count value ht by one upon receipt of 1 pulse of the hall signal from the hall sensor HS of the motor 9.

The controller 10 includes an interface 20 configured to receive a print instruction. The interface 20 is, for example, configured to receive a user operation of instructing printing process. Further, the interface 20 may be a communication interface configured to receive a print instruction from an external device via wired communication or wireless communication. The controller 10 starts raising the temperature of the fixing device 8 with use of the heater 8 after receiving the printing instruction through the interface 20. On condition that a detected temperature TD of the temperature sensor 85 reaches a particular temperature TM, the controller 10 starts operating the motor 9. The particular temperature TM is determined based on a flag F indicating whether the pressure plate 32 is placed at a position where the sheet S on the sheet tray 31 is placed at the feedable position.

When the pressure plate 32 is placed at the position where the sheets S can be fed at a time when the printing instruction is received, the controller 10 sets the particular temperature TM to a first temperature X1, while when the pressure plate 32 is not placed at the position where the sheets S can be fed at a time when the printing instruction is received, the controller 10 sets the particular temperature TM to a second temperature X2. It is noted that the second temperature X2 is lower than the first temperature X1.

When a temperature of the fixing device 8 heated by the heater 84 is raised from a particular initial temperature to a temperature equal to a fixable temperature TF as a time TA necessary for driving the pressure plate 32 to lift up the sheets S to the feedable position has elapsed from when the operation of the motor 9 is started, and further a time TB necessary for conveying the sheet S from the sheet tray 31 to the fixing device 8 has elapsed, the particular initial temperature is called as an ideal second temperature. The fixable temperature TF is a temperature at which the fixing device 8 can thermally fix a developer image on the sheets S. According to the illustrative embodiment, the second temperature X2 is set to be equal to or higher than the ideal second temperature. Therefore, if the fixing device 8 of the second temperature X2 is heated by the heater 84 and the time TA and TB have elapsed in that state, the temperature of the fixing device 8 becomes equal to or higher than the fixable temperature TF (see FIGS. 5A, 5B-1 through 5B-5).

The controller 10 stores the flag F indicating the position of the pressure plate 32. When the motor 9 is driven by a particular amount, the controller 10 sets the value of the flag F to one indicating that the pressure plate 32 is placed at a position where the sheets S are placed at the feedable position. When the sheet tray sensor 31A detects that the sheet tray 31 is detached from the main body, the controller 10 sets the value of the flag F to zero indicating that that the pressure plate 32 is not placed at a position where the sheets S are placed at the feedable position. According to the illustrative embodiment, the particular amount is a rotation amount of the motor 9 sufficient for moving the pressure plate 32 placed at the reference position (i.e., the lowermost position) to the uppermost position thereof. Further, according to the illustrative embodiment, the position of the sheets S is lifted up by the pressure plate 32. When the pressure plate 32 is placed at the position where the sheets S can be fed, the sheet S is placed at the feedable position at which the uppermost sheet S contacts the pickup roller 33. On the other hand, when the pressure plate 32 is not placed at the position where the sheets S can be fed, the sheet S is not placed at the feedable position. Therefore, the flag F may indicate the position of the sheet S (i.e., whether the sheet S on the sheet tray 31 is placed at feedable the position) in place of the position of the pressure plate 32.

Next, an example of a process executed by the controller 10 to manage the position of the pressure plate 32 will be described in detail.

Figure 3:
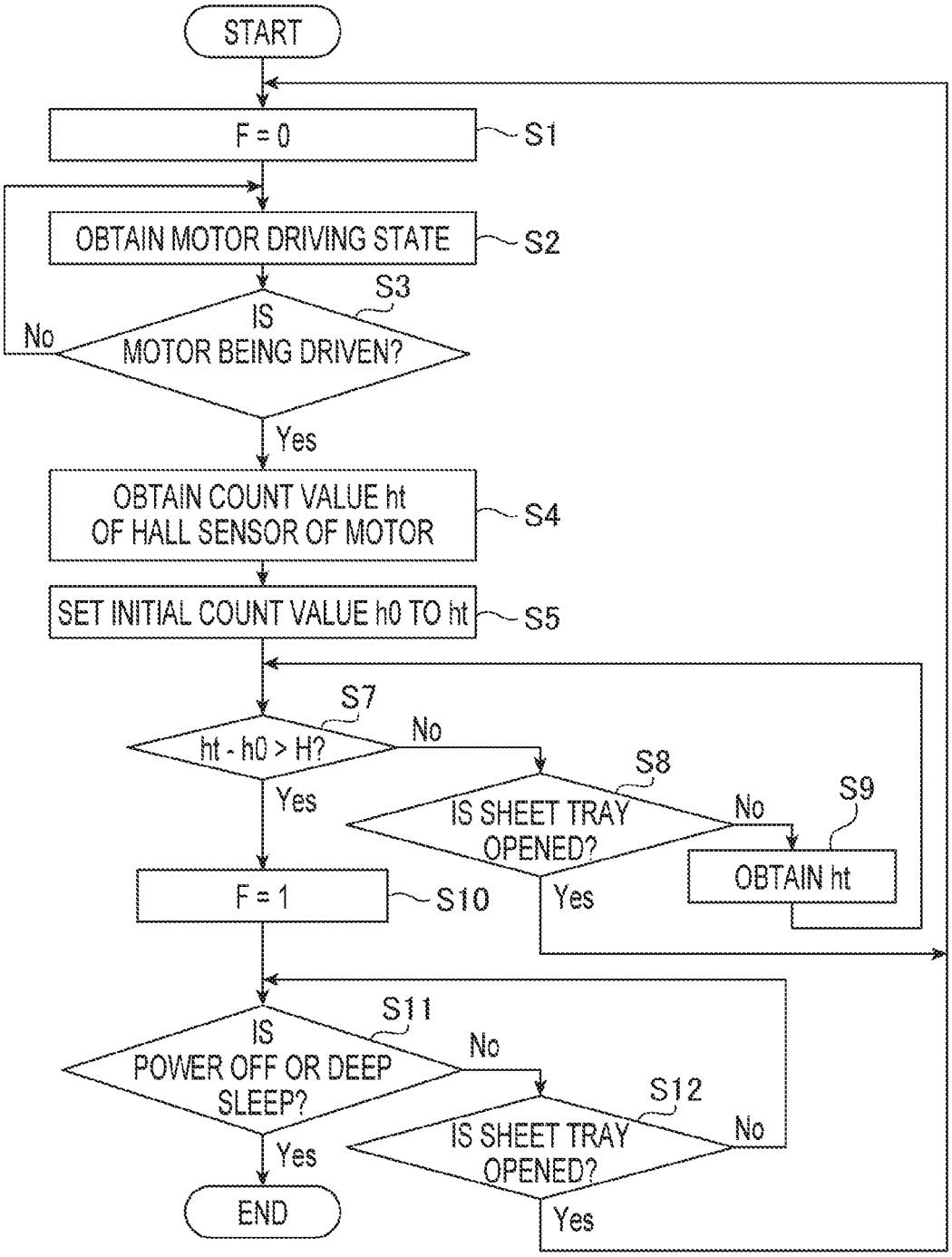
FIG. 3 is a flowchart illustrating a process of managing a position of a pressure plate.

As shown in FIG. 3, when the laser printer 1 is powered ON, or when the laser printer 1 is returned from a deep sleep state, the controller 10 is unable to determine the position of the pressure plate 32. Therefore, in such a case, the controller 10 assumes that the sheets S are not placed at the feedable position and sets the flag F to zero (S1). Thereafter, the controller 10 obtains the driving state of the motor 9 (S2) and determines whether the motor 9 is being driven (S3).

When it is determined that the motor 9 is not being driven (S3: NO), since the pressure plate 32 is stopped, the controller 10 returns to S2 and awaits until the motor 9 is driven. When it is determined that the motor 9 is being driven (S3: YES), since the pressure plate 32 is lifted up, the controller 10 obtains the count value ht of the hall counter HC (S4), and stores the count value ht obtained in S4 in a memory as an initial count value h0 (S5).

After S5, the controller 10 determines whether a value calculated by subtracting the initial count value h0 from the count value ht of the hall counter HC is greater than a particular value H (i.e., whether ht−h0>H) (S7). It is noted that the particular value H is a count value of the hall sensor HS corresponding to a rotating amount of the motor sufficient for moving the pressure plate 32 placed at the reference position to its uppermost position.

When it is determined that the particular value calculated by subtracting the initial count value h0 from the count value ht of the hall counter HC is equal to or less than the particular value H (S7: NO), the controller 10 determines whether the sheet tray 31 is in the closed state based on the signal transmitted from the sheet tray sensor 31A (S8).

When it is determined that the sheet tray 31 is not in the opened state (S8: NO), the controller 10 obtains the count value ht of the hall counter HC (S9), and returns to S7. On the other hand, when it is determined that the sheet tray 31 is in the opened state (S8: YES), the controller 10 returns to S1 and sets the flag F to zero since the pressure plate 32 is moved down to the reference position and the sheets S are not placed at the feedable position any more.

When it is determined that the particular value calculated by subtracting the initial count value h0 from the count value ht of the hall counter HC is greater than the particular value H (S7: NO), the sheets S should have been lifted up to the feedable position, the controller 10 sets the flag F to one (S10).

Then, the sheet tray 31 is in a sheet feedable state, and when the laser printer 1 is powered OFF or goes into the deep sleep state (S11: YES), the process of managing the position of the pressure plate 32 is terminated. When the laser printer 1 is not powered OFF and the laser printer 1 does not go into the deep sleep state (S11: NO), the controller 10 determines whether the sheet tray 31 is in the opened state (S12).

When it is determined that the sheet tray 31 is not in the opened state (S12: NO), the controller 10 returns to S11. On the other hand, when it is determined that the sheet tray 31 is in the opened state (S12: YES), the controller 10 returns to S1 and sets the flag F to zero since the pressure plate 32 is not placed at the position where the sheets S can be fed (i.e., the sheets S are not placed at the feedable position).

Next, an example of a process when the controller 10 raises the temperature of the fixing device 8 will be described.

Figure 4:
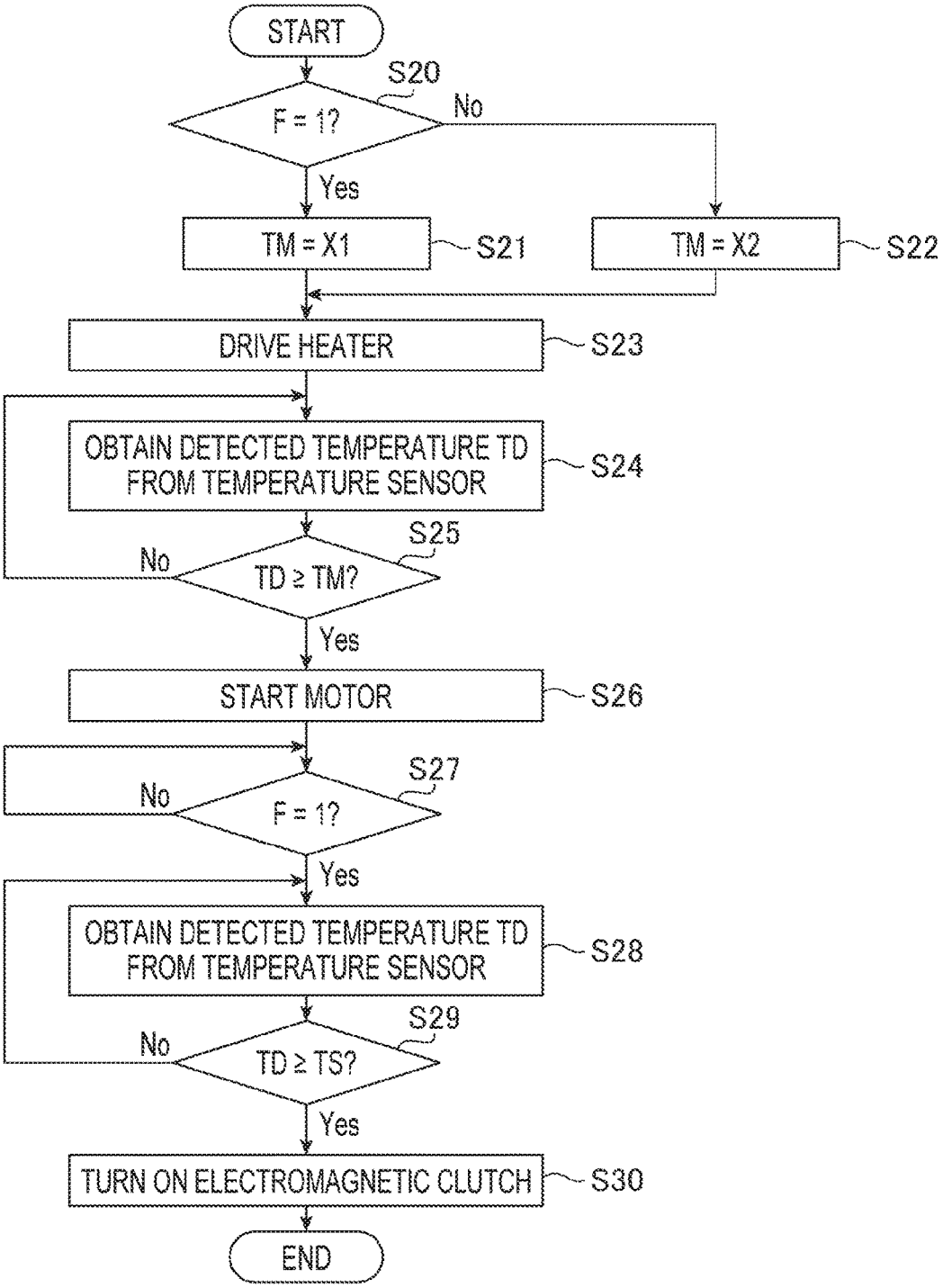
FIG. 4 is a flowchart illustrating a process from start raising temperature of a fixing device until start supplying a sheet.

As shown in FIG. 4, upon receipt of the printing instruction, the controller 10 determines whether the pressure plate 32 is placed at the position where the sheets S are placed at the feedable position (i.e., whether F=1) (S20).

When it is determined that the pressure plate 32 is placed at the position where the sheets S are placed at the feedable position (F=1) (S20: YES), the controller 10 sets the particular temperature TM to the first temperature X1 (S21).

When it is determined that the pressure plate 32 is not placed at the position where the sheets S are placed at the feedable position (F=0) (S20: NO), the controller 10 sets the particular temperature TM to the second temperature X2 (S22).

After execution of S21 or S22, the controller 10 drives the heater 84 (S23) and obtains the detected temperature TD from the temperature sensor 85 (S24). Thereafter, the controller 10 determines whether the detected temperature TD has reached the particular temperature TM (i.e., whether TD≥TM) in S25.

When it is determined that the detected temperature has reached the particular temperature TM (i.e., TD≥TM) (S25: YES), the controller 10 drives the motor 9 (S26), and determines whether the flag F is one (S27).

When it is determined that the flag F is not one (S27: NO), the controller 10 returns to S27 and awaits until the flag F becomes one since the sheets S are not placed at the feedable position. When it is determined that the flag F is equal to one (S27: YES), the controller 10 obtains the detected temperature TD from the temperature sensor 85 (S28), and determines whether the detected temperature TD has reached a sheet feedable temperature TS (TD≥TS) (S29). It is noted that the sheet feedable temperature TS is a temperature from which the temperature of the fixing device 8 is raised to the fixable temperature TF when a time necessary for the sheet S to move from the sheet tray 31 to the fixing device 8 has elapsed.

When it is determined that the detected temperature TD has not reached the sheet feedable temperature TS (S29: NO), the controller 10 returns to S28, and repeats steps S28 and S29 until the detected temperature TD reaches the sheet feedable temperature TS. When it is determined that the detected temperature TD has reached the sheet feedable temperature TS (S29: YES), the controller turns ON the electromagnetic clutch 33A to feed the sheet S from the sheet feeder 3, and terminates the process.

Next, referring to FIGS. 5A, 5B-1 through 5B-5 and 5C-1 through 5C-5, an example of a process of the laser printer 1 controller by the controller 10 will be described. Hereinafter, for the sake of description, FIGS. 5B-1 through 5B-5 will also be collectively referred to as FIG. 5B, and FIGS. 5C-1 through 5C-5 will also be collectively referred to as FIG. 5C.

Figure 5A:
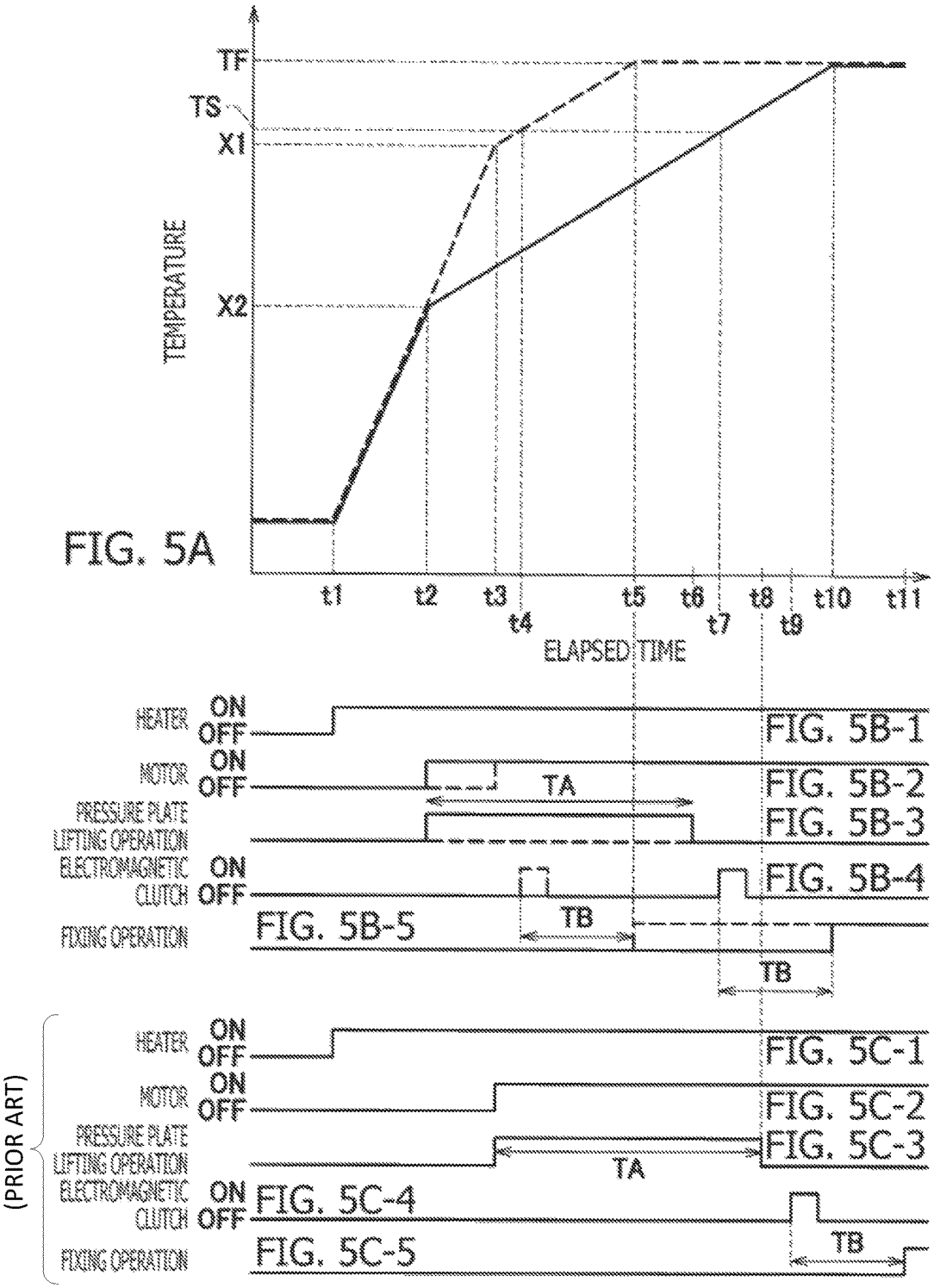
FIG. 5A is a graph showing a relationship between an elapsed time and a temperature of the fixing device.

In the graph shown in FIG. 5A, the temperature of the fixing device 8 when the pressure plate 32 is placed at the position where the sheets S are placed at the feedable position (i.e., F=1) is indicated by a broken line, and the temperature of the fixing device 8 when the pressure plate 32 is not placed at the position where the sheets S are placed at the feedable position (i.e., F=0) is indicated by a solid line. Similarly, in FIG. 5B, operations when the pressure plate 32 is placed at the position where the sheets S are placed at the feedable position (i.e., F=1) is indicated by broken lines, while operations when the pressure plate 32 is not placed at the position where the sheets S are placed at the feedable position (i.e., F=0) is indicated by solid lines.

As shown in FIG. 5A, when the pressure plate 32 is placed at the position where the sheets S are placed at the feedable position (i.e., F=1), in response to receipt of the printing instruction, the controller 10 turns ON the heater 84 of the fixing device 8 (t1), thereby the temperature of the fixing device 8 rising. When the temperature of the fixing device 8 reaches the first temperature X1 (t3), the controller 10 starts driving the motor 9. When the motor 9 is driven, a temperature rising gradient of the fixing device 8 becomes smaller in comparison with a case where the motor 9 is not driven.

Thereafter, when the temperature of the fixing device 8 has reached the sheet feedable temperature TS (t4), the controller 10 turns ON the electromagnetic clutch 33A to start feeding the sheet S from the sheet feeder 3. When the time TB necessary for conveying the sheet S from the sheet tray 31 to the fixing device 8 after the electromagnetic clutch 33A is turned ON has elapsed (t5), the sheet S has reached the fixing device 8 and the fixing operation is started. At this state, the temperature of the fixing device 8 has reached the fixable temperature TF.

When the pressure plate 32 is not placed at the position where the sheets S are placed at the feedable position (i.e., F=0), in response to receipt of the printing instruction, the controller 10 turns ON the heater 84 of the fixing device 8 (t1), thereby the temperature of the fixing device 8 rising. When the temperature of the fixing device 8 reaches the second temperature X2 (t2), the controller 10 starts driving the motor 9. When the motor 9 is driven, a temperature rising gradient of the fixing device 8 becomes smaller in comparison with a case where the motor 9 is not driven.

When the motor 9 is started to be driven, as shown in FIG. 5B, the pressure plate 32 is lifted up. When the time TA necessary for lifting up the pressure plate 32 to the position where the sheets S can be fed has elapsed (t6) and the temperature of the fixing device 8 has reached the sheet feedable temperature TS (t7), the controller 10 turns ON the electromagnetic clutch 33A to feed the sheet S from the sheet feeder 3. When the time TB necessary for conveying the sheet S from the sheet tray 31 to the fixing device 8 after the electromagnetic clutch 33A is turned ON has elapsed (t10), the sheet S has reached the fixing device 8 and the fixing operation is started. At this state, the temperature of the fixing device 8 has reached the fixable temperature TF.

When a conventional control as shown in FIG. 5C is applied, the controller starts driving the motor 9 when the temperature of the fixing device 8 has reached the first temperature X1 after the heater 84 of the fixing device 8 is turned ON regardless of the location of the pressure plate 32. According to the conventional art, since the motor 9 is not driven during a period from t1 to t3, and therefore, the pressure plate 32 does not move during this period. When the controller 10 starts driving the motor 9 at t3, lifting of the pressure plate 32 starts. After the lifting operation of the pressure plate 32 is completed (t8), the controller 10 turns ON the electromagnetic clutch 33A (t9) and the fixing operation is started (t11).

It is understood by comparing FIG. 5B with FIG. 5C that, with use of the laser printer 1 according to the illustrative embodiment, operation of the driving source can be started earlier in comparison with the conventional art, thereby pickup of the sheet S (i.e., turning ON of the electromagnetic clutch) and start of the fixing operation can be started earlier.

As described above, with use of the laser printer 1 according to the present disclosures, effects as described below can be achieved.

According to the laser printer 1, when the printing instruction is received in a state where the pressure plate 32 is not placed at the position where the sheets S can be fed, the controller 10 sets the particular temperature TM to the second temperature X2 which is lower than the first temperature X1. On condition that the detected temperature TD of the temperature sensor 85 becomes the particular temperature TM, the controller 10 starts driving the motor 9. That is, when the pressure plate 32 is not placed at the position where the sheets S can be fed when the printing instruction is received, the motor 9 is started to be driven earlier than in a case where the pressure plate 32 is placed at the position where the sheets S can be fed. Therefore, in a configuration where the pressure plate 32, the fixing device 8 and the sheet conveying mechanism are driven by a single motor 9, start of feeding the first sheet S can be made earlier.

According to the laser printer 1, the controller 10 can determine whether the sheet S on the sheet tray 31 is placed at the feedable position (i.e., whether the pressure plate 32 is placed at the position where the sheets S can be fed) as the sheet tray sensor 31A detects the opened or closed state of the sheet tray 31. Therefore, it is unnecessary to optionally provide a sensor to detect the position of the pressure plate 32, and a manufacturing cost can be suppressed.

Further, since an operation to lift up the pressure plate 32, a sheet conveying operation by the fixing device 8, an operation of the process unit 4 and an operation of the pickup roller 33 can be driven by a single motor 9, a manufacturing cost can be suppressed.

It is noted that present disclosures need not be limited to the configurations of the above-described illustrative embodiment, but can be modified in various ways. In the following description, components/elements similar to those in the illustrative embodiment will be assigned with the same reference numerals and the detailed description on such components and elements will be omitted.

In the above-described illustrative embodiment, the operation of the motor is started on condition that the detected temperature of the temperature sensor has reached the particular temperature after receipt of the printing instruction. Such a configuration may be modified such that the operation of the motor may be started on condition that a particular period has elapsed with respect to a particular reference time after the printing instruction is received.

Figure 6:
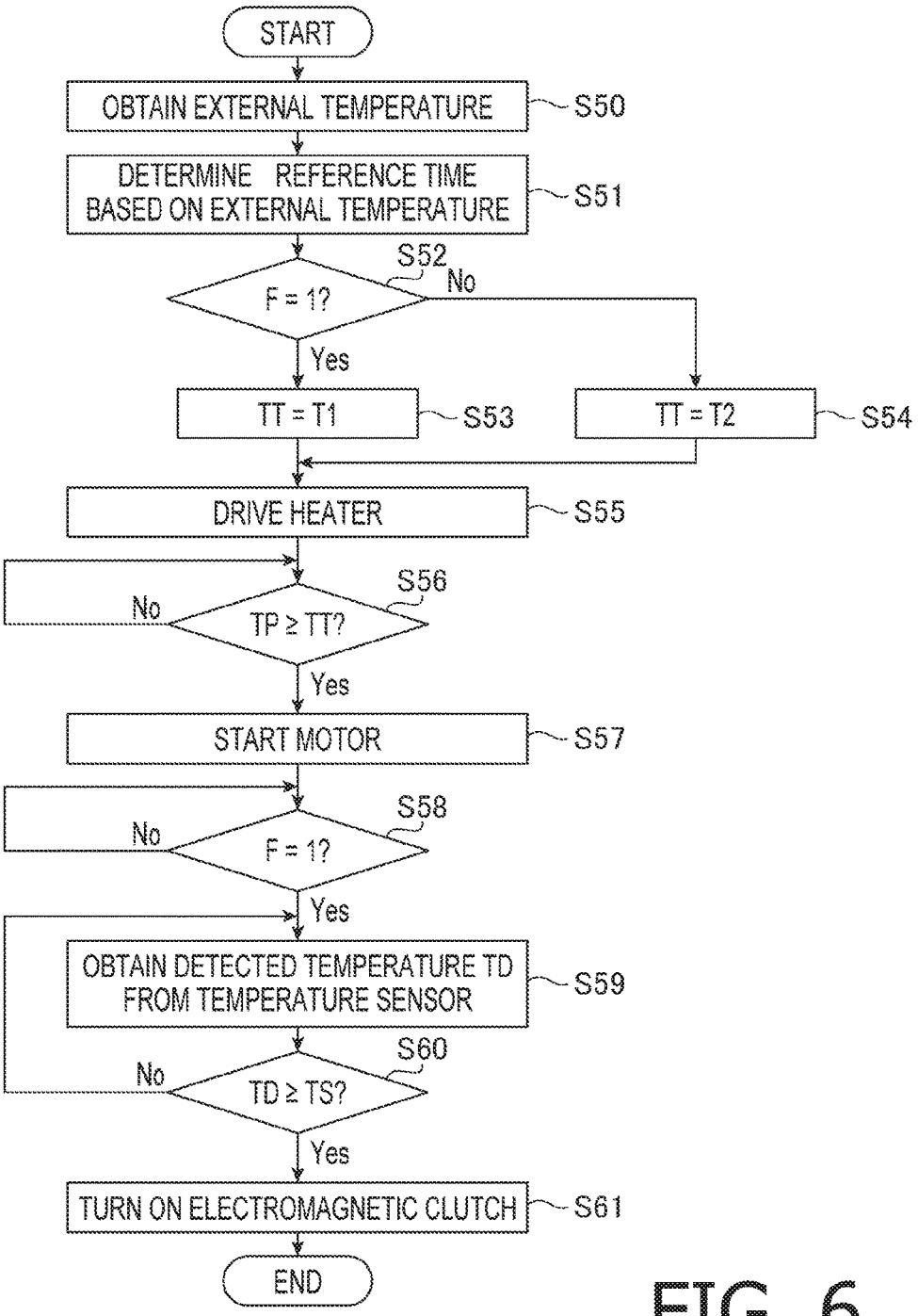
FIG. 6 is a flowchart illustrating a process of the controller according to another illustrative embodiment.

For example, as shown in FIG. 6, a controller 100 according to another embodiment is configured to obtain an external temperature (S50) after receipt of the printing instruction. Then, the controller 100 determines a reference time based on the obtained external temperature (S51), and further determines whether the flag F is set to one (S52). It is noted that the reference time is an estimated time period from when the heater 84 is turned ON until a temperature of the heater 84 reaches a specific temperature. A time period from turning ON of the heater 84 to the reference time is set to be long when the external temperature is low and short when the external temperature is high.

When the controller 100 determines that the pressure plate 32 is placed at the position where the sheets S are placed at the feedable position (i.e., F=1) (S52: YES), the controller 100 sets a particular time TT to a first time T1 (S53). When the controller 100 determines that the pressure plate 32 is not placed at the position where the sheets S are placed at the feedable position (i.e., F=0) (S52: NO), the controller 100 sets a particular time TT to a second time T2 (S53). It is noted that the second time T2 is shorter than the first time T1.

After execution of S53 or S54, the controller 100 turns ON the heater 84 (S55), and determines whether a passage time TP from the reference time exceeds the particular time TT (i.e., whether TP≥TT) (S56).

When it is determined that the passage time TP from the reference time exceeds the particular time TT (i.e., TP≥TT) (S56: YES), the controller 10 starts driving the motor 9. When it is determined that the passage time TP from the reference time does not exceed the particular time TT (i.e., TP<TT) (S56: NO), the controller 10 returns to S56 and awaits until the passage time TP from the reference time exceeds the particular time TT (i.e., TP≥TT).

Since control from S57 to S61 is similar to the control from S26 to S30 of the illustrative embodiment, description thereof is omitted.

It is noted that, after receipt of the printing instruction, the controller 100 may set a fixed time as the particular reference time regardless of the external temperature. In such a case, steps S50 and S51 can be omitted.

According to the image forming apparatus provided with the controller 100 configured as above, when the printing instruction is received in a state where the sheets S are not placed at the feedable position, the controller 100 sets the particular time to the second time T2 which is shorter than the first time T1, and starts driving the motor 9 on condition that the particular time has elapsed from the particular reference time. That is, if the sheets S are not placed at the feedable position when the controller 100 receives the printing instruction, the controller 100 starts driving the motor 9 at an earlier timing than in a case where the sheets S are placed at the feedable position. Therefore, in a configuration where movement of the pressure plate 32 and conveyance of the sheet S by the fixing device 8 are driven by a single motor 9, start of printing of the first page can be made earlier.

According to the illustrative embodiment, the second temperature X2 is equal to or higher than the ideal second temperature. Aspects of the present disclosure need not be limited to such a configuration, and can be modified. For example, the second temperature X2 may be lower than the ideal second temperature.

Even in such a case, if the second temperature X2 is not so different from the ideal second temperature, it is still possible to make start printing of the first sheet earlier in a configuration where the movement of the pressure plate 32 and the conveyance of the sheet S by the fixing device 8 are driven by a single driving source. It is noted that if the detected temperature TD of the fixing device 8 has not reached the sheet feedable temperature TS when the lifting operation of the pressure plate 32 is completed, the electromagnetic clutch 33A may be actuated after the temperature has reached the sheet feedable temperature TS.

In the illustrative embodiment, as an example of the image forming apparatus, a monochromatic laser printer is described. It is noted that the image forming apparatus according aspects of the present disclosures can be a color image forming apparatus, a copier, an MFP and the like. Further, the sheet S needs not be limited to the printing sheet. That is, the sheet could be, for example, an OHP sheet. Further, the heating unit need not be limited to one employing a belt, but could be one employing a roller. Further, the pressing unit need not be limited to one employing a roller, but could be one employing a belt. Furthermore, the temperature sensor may be arranged at arbitrary position.

According to the illustrative embodiment, the halogen lamp is employed as an example of the heater. Aspects of the present disclosures need not be limited to such a configuration and a resistance heater such as a carbon heater and a ceramic heater may be employed.

According to the illustrative embodiment, the sheet tray sensor is arranged above the front end part of the sheet tray. Aspects of the present disclosures need not be limited to such a configuration and the sheet tray sensor may be arranged to another position such as a rear end part of the sheet tray.

According to the illustrative embodiment, whether the driving amount of the motor (i.e., the rotation amount) has reached the particular amount is determined based on the count value of the hall counter. Aspects of the present disclosures need not be limited to such a configuration and the determination can be made based on a driving time period of the motor.

According to the illustrative embodiment, the sheet tray sensor is configured to transmit the ON signal to the controller when the sheet tray is detached from the main body. Aspects of the present disclosures need not be limited to such a configuration and the sheet tray sensor may be configured to transmit an ON signal when the sheet tray is attached to the main body.

It is noted that various elements, components and the like referred to in the illustrative embodiment and its modifications can be arbitrarily combined to embody aspects of the present disclosures.

What is claimed is:

1. An image forming apparatus, comprising:

a main body;

a sheet tray configured to mount a sheet thereon, the sheet tray being attachable to and detachable from the main body;

a pressure plate provided to the sheet tray, the pressure plate being configured to lift up the sheet to a feedable position;

a fixing device including a heater and a temperature sensor, the fixing device being configured to convey the sheet and thermally fix a developer image on the sheet, the temperature sensor being configured to detect a temperature of the fixing device;

a driving source configured to supply a driving force for a driving operation of driving the pressure plate to lift up the sheet and driving the fixing device to convey the sheet;

an interface configured to receive a printing instruction; and a controller configured to:

start heating the fixing device by the heater in response to receipt of the printing instruction through the interface; and control the driving source to start the driving operation on condition that the temperature detected by the temperature sensor reaches a particular temperature, wherein, in response to receipt of the printing instruction, the controller sets the particular temperature to:

a first temperature X1 when the pressure plate has placed the sheet to the feedable position; and a second temperature X2 lower than the first temperature X1 when the pressure plate has not placed the sheet to the feedable position.

2. The image forming apparatus according to claim 1, further comprising a sheet tray sensor configured to detect whether the sheet tray is attached to the main body or detached from the main body, wherein the controller is configured to:

store a flag indicating whether the pressure plate is placed at a position where the sheet is placed at the feedable position;

in response to the driving source being driven by a particular amount, set the flag to a first value indicating that the pressure plate is placed at the position where the sheet is placed at the feedable position; and in response to the sheet tray sensor detecting that the sheet tray is detached from the main body, set the flag to a second value indicating that the pressure plate is not placed at the position where the sheet is placed at the feedable position.

3. The image forming apparatus according to claim 2, wherein, in response to the sheet tray being detached from the main body, the pressure plate is moved downward to a lowermost position.

4. The image forming apparatus according to claim 1, further comprising a a process unit configured to form the developer image on the sheet, wherein the process unit is driven by the driving source.

5. The image forming apparatus according to claim 1, further comprising a pickup roller configured to contact the sheet placed at the feedable position from above and pick up the sheet, wherein the pickup roller is driven by the driving source.

6. The image forming apparatus according to claim 1, wherein the second temperature X2 is determined such that the temperature of the fixing device is raised from the second temperature X2 to a temperature equal to or higher than a fixable temperature, when the fixing device is heated by the heater, and a time necessary for driving the pressure plate to lift up the sheet to the feedable position and a time for conveying the lifted sheet from the sheet tray to the fixing device have elapsed, after the driving operation of the driving source is started, the fixable temperature being a temperature at which the fixing device can thermally fix the developer image on the sheet.

7. An electrophotographic image forming apparatus, comprising:

a housing;

a process unit configured to form a developer image on a sheet;

a sheet tray attachable to and detachable from the housing, the sheet tray comprising a pressure plate configured to support the sheet mounted thereon, the pressure plate being movable between a first position where the pressure plate lifts up the sheet and a second position where the pressure plate does not lift up the sheet;

a pickup roller configured to contact the sheet when the pressure plate is in the first position and feed the sheet to the process unit;

a fixing device including a heater and a temperature sensor, the fixing device being configured to convey the sheet and thermally fix the developer image on the sheet, the temperature sensor being configured to detect a temperature of the fixing device;

a motor configured to drive the pressure plate, the process unit, the pickup roller and the fixing device; and a controller, wherein the controller is configured to:

set a particular temperature to a first temperature X1 if the pressure plate is placed at the first position when receiving a printing instruction;

set the particular temperature to a second temperature X2 lower than the first temperature X1 if the pressure plate is placed at the second position when receiving the printing instruction; and start heating the fixing device by controlling the heater in response to receipt of the printing instruction and start driving the motor on condition that the temperature detected by the temperature sensor reaches the particular temperature.

8. The electrophotographic image forming apparatus according to claim 7, further comprising a sheet tray sensor configured to detect whether the sheet tray is attached to the housing or detached from the housing, wherein the pressure plate is moved to the second position in response to the sheet tray being detached from the housing, and wherein the controller is configured to:

store a flag indicating whether the pressure plate is placed at the first position;

in response to the motor being driven by a particular amount, set the flag to a value indicating that the pressure plate is placed at the first position; and in response to the sheet tray sensor detecting that the sheet tray is detached from the housing, set the flag to a value indicating that the pressure plate is not placed at the first position.

9. The electrophotographic image forming apparatus according to claim 7, wherein the second temperature X2 is determined such that the temperature of the fixing device is raised from the second temperature X2 to a temperature equal to or higher than a fixable temperature, when the fixing device is heated by the heater, and a time necessary for moving the pressure plate from the second position to the first position and a time for conveying the sheet from the sheet tray to the fixing device have elapsed, after driving of the motor is started, the fixable temperature being a temperature at which the fixing device can thermally fix the developer image on the sheet.

10. An image forming apparatus, comprising:

a main body;

a sheet tray configured to mount a sheet thereon, the sheet tray being attachable to and detachable from the main body;

a pressure plate attached to the sheet tray, the pressure plate being configured to lift up the sheet to a feedable position;

a fixing device including a heater, the fixing device being configured to convey the sheet and thermally fix a developer image on the sheet;

a driving source configured to supply a driving force for a driving operation of driving the pressure plate to lift up the sheet and driving the fixing device to convey the sheet;

an interface configured to receive a printing instruction; and a controller configured to:

start heating the fixing device by the heater in response to receipt of the printing instruction through the interface; and control the driving source to start the driving operation on condition that a particular time period has elapsed from a reference time set at a time after receiving the printing instruction;

wherein, in response to receipt of the printing instruction, the controller sets the particular time period to:

a first time period T1 when the pressure plate has placed the sheet to the feedable position; and a second time period T2 shorter than the first time period T1 when the pressure plate has not placed the sheet to the feedable position.

11. An electrophotographic image forming apparatus, comprising:

a housing;

a process unit configured to form a developer image on a sheet;

a sheet tray attachable to and detachable from the housing, the sheet tray comprising a pressure plate configured to support the sheet mount thereon, the pressure plate being movable between a first position where the pressure plate lifts up the sheet and a second position where the pressure plate does not lift up sheet;

a pickup roller configured to contact the sheet when the pressure plate is in the first position and feed the sheet to the process unit;

a fixing device including a heater, the fixing device being configured to convey the sheet and thermally fix the developer image on the sheet;

a motor configured to drive the pressure plate, the process unit, the pickup roller and the fixing device; and a controller, wherein the controller is configured to:

start heating the fixing device by the heater in response to receipt of a printing instruction;

set a particular time period to a first time period T1 if the pressure plate is placed at the first position when receiving the printing instruction;

set the particular time period to a second time period T2 shorter than the first time period T1 if the pressure plate is placed at the second position when receiving the printing instruction; and start driving the motor on condition that the particular time period has elapsed from a reference time set at a time after receiving the printing instruction.

* * * * *